US010415340B2

(12) United States Patent
Cavalheiro et al.

(10) Patent No.: US 10,415,340 B2
(45) Date of Patent: Sep. 17, 2019

(54) DEVICE WITH ASSEMBLY AND INSTALLATION IN CASING COLUMN COUPLED TO A MANDREL FOR DISOBSTRUCTING A DRILLING WELL

(71) Applicant: SLIM DRILLING SERVICOS DE PERFURACAO S.A., Belo Horizonte-MG (BR)

(72) Inventors: Antonio Sergio Cavalheiro, Belo-Horizonte (BR); Mario Cesar Pereira Dos Santos, Belo Horizonte (BR); Leandro Diniz Brandao Rocha, Belo Horizonte (BR); Hamilton Suss Junior, Belo Horizonte (BR); Jose Roberto Scalon Cotello, Belo Horizonte (BR); Ronaldo Soares Eisele, Belo Horizonte (BR)

(73) Assignee: SLIM DRILLING SERVICOS DE PERFURACAO S.A., Belo Horizonte, MG (BR)

( * ) Notice: Subject to any disclaimer, the term of this patent is extended or adjusted under 35 U.S.C. 154(b) by 246 days.

(21) Appl. No.: 15/106,775

(22) PCT Filed: Dec. 18, 2013

(86) PCT No.: PCT/BR2013/000581
§ 371 (c)(1),
(2) Date: Feb. 24, 2017

(87) PCT Pub. No.: WO2015/089597
PCT Pub. Date: Jun. 25, 2015

(65) Prior Publication Data
US 2017/0218718 A1 Aug. 3, 2017

(51) Int. Cl.
*E21B 21/02* (2006.01)
*E21B 33/14* (2006.01)
*E21B 33/068* (2006.01)

(52) U.S. Cl.
CPC ..... *E21B 33/068* (2013.01); *E21B 21/02* (2013.01); *E21B 33/14* (2013.01)

(58) Field of Classification Search
CPC ..... E21B 33/068; E21B 21/02; E21B 33/14
See application file for complete search history.

(56) References Cited

U.S. PATENT DOCUMENTS 1,861,485 A * 6/1932 Tremolada ..... E21B 21/02 285/275
2,029,598 A * 2/1936 Timbs ..... E21B 21/02 277/516

(Continued)

FOREIGN PATENT DOCUMENTS

GB 2 164 374 A * 3/1986 ..... E21B 21/02
WO 2013104069 A1 7/2013

OTHER PUBLICATIONS

International Search Report, PCT/BR2013/000581, dated Aug. 28, 2014.

*Primary Examiner* — James G Sayre
(74) *Attorney, Agent, or Firm* — Scott Houtteman; Houtteman Law LLC

(57) ABSTRACT

To clear the probing shaft. Comprised of an assembled spin set from a vented axle (6) with seals, coupled to an upper head (34) with an eyelet (41) and fluid input (40). From the threaded lower end (7) of the axle (6) to the fluid input (40), an inner fluid passage is formed in the device. After fixing the device to the coating column (R), the latter, after finding hindrances (O) on the oil/gas shaft (P) bottom in the shaft cementing phase, will be constantly rotated around the axle (7) by the chuck (MA) of the probing equipment simulta- (Continued)

neously to the fluid injection (F). With the spin combined to the fluid combined to the fluid injection (F), the hindrance (O) in the shaft wall (P) shall be eroded and eliminated, allowing the passage of such coating column (R) to reach the bottom in the cementing phase.

4 Claims, 13 Drawing Sheets

(56) References Cited

U.S. PATENT DOCUMENTS

| | | | | |
|---|---|---|---|---|
| 2,127,312 | A * | 8/1938 | Seamark | E21B 33/04 166/84.1 |
| 8,567,511 | B2 | 10/2013 | Mackenzie | |
| 2006/0185841 | A1* | 8/2006 | Swagerty | E21B 33/068 166/88.1 |
| 2008/0271884 | A1* | 11/2008 | Robichaux | E21B 33/068 166/242.1 |
| 2011/0162852 | A1* | 7/2011 | Nguyen | E21B 17/046 166/378 |
| 2012/0285743 | A1* | 11/2012 | Gosselin | E21B 37/00 175/53 |
| 2012/0292046 | A1* | 11/2012 | Klimack | E21B 33/05 166/378 |
| 2013/0025850 | A1 | 1/2013 | Eriksen | |
| 2016/0090816 | A1* | 3/2016 | Gosselin | E21B 34/06 166/332.1 |

* cited by examiner

SECTION A-A

15A

CORTE A-A

DEVICE WITH ASSEMBLY AND INSTALLATION IN CASING COLUMN COUPLED TO A MANDREL FOR DISOBSTRUCTING A DRILLING WELL

The descriptive report hereof refers to a patent of invention request to an item set whose assembly creates a new device to be installed in the coating column used on cementing of probing, gas/oil and/or mineral shaft walls.

After inserting this coating tubular column in the shaft (in the cementing phase), if obstruction prevents it from reaching the bottom, the device object of the patent request hereof, allows the coating column to be coupled to the probing equipment rolling chuck that injects the fluid simultaneously in torque for the wall thinning until it is clear, so the said coating may reach the shaft bottom.

After the coating column surpasses the clear point and reaches the shaft bottom, it automatically applies the cement paste injection to coat the shaft wall, then avoiding intervals to replace equipment and slowness in the shaft cementing phase.

TECHNIQUE STATUS

As it is known by technicians in this mineral and/or gas/oil probing segment, as long as the soil is drilled by the chaplet drill, the shaft wall must be coated with steel tubes and cemented with a cement paste to isolate intermediary rock zones and keep normal upside and downside movements of the drilling column, without obstruction.

In this cementing phase, through the lifting equipment, the drilling column is removed and a so-called coating tubular column is inserted in place of it, which in its terminal (shoe), along with the shaft bottom, injects the cement paste, rising due to the huge pressure and adheres itself to the gap between the shaft wall and the coating column, then proceeding with the cementing operation (with the cement paste). Then the surface equipment are demobilized and the drilling column is once again inserted to proceed with the chaplet drill operation, activated by the probing equipment chuck, thinning the waste cement forged on the shaft bottom and penetrating the soil normally.

It happens that due to its own aggressive drilling features, shaft wall landslides create "holes" or obstructions that obstruct the full coating column lowering until the bottom, in the said cement paste injection phase. If it is forced by its own weight against the obstruction found, the said coating column may be damaged. In such cases, a fluid is injected instead of the cement paste through the coating column terminal, which goes upward from the shaft bottom through the void gap, until it reaches the obstruction in order to "soften it", "thin it" or "erode it" in a continuous flow and strong pressure applied. Therefore, this procedure is needed so the coating column may reach the shaft bottom and the wall cementing may be carried out successfully.

However, this coating operation may become even more complex in case the clearing operation is not made successfully at its beginning (even though the fluid is injected). It might happen due to the material hardness (obstruction) found, then with a probing equipment column lifting system, the coating column must be removed, and the drilling column coupled to a chuck shall be inserted once again to conclude the thinning procedure on the obstruction through the chaplet drill. Only this way, after removing the drilling column with the opened chuck and with the probing lifting system, the coating column may be inserted again to eventually inject the cement paste between the coating and shaft wall. Then, with the help of the probing equipment column lifting system, the drilling column is inserted once again within the shaft and the next drilling phase is restarted (if there is such new drilling phase).

As it is noted, the clearing operation inside the shaft during the coating column lowering phase might become expensive, considering such handling and additional equipment replacement, slowing down the shaft drilling system for mineral and oil/gas probing.

PURPOSE OF PATENT

The device hereof, object of this patent request, shall enable the coating column spin simultaneously to the fluid injection if there is an obstruction in the drilling shaft wall. Thus the coating column may be operated in low torque (without damage) in combination with the fluid injection to erode or thin the obstruction inside the shaft, proceeding with cement paste injections without removing and reinserting alternatively the drilling column in this phase (as it usually occurs).

BRIEF DESCRIPTION OF THE DRAWINGS

In a superficial explanation, the device, assembly system and their related operation may be better detailed in the attached drawings, in which we see.

Figure 1:
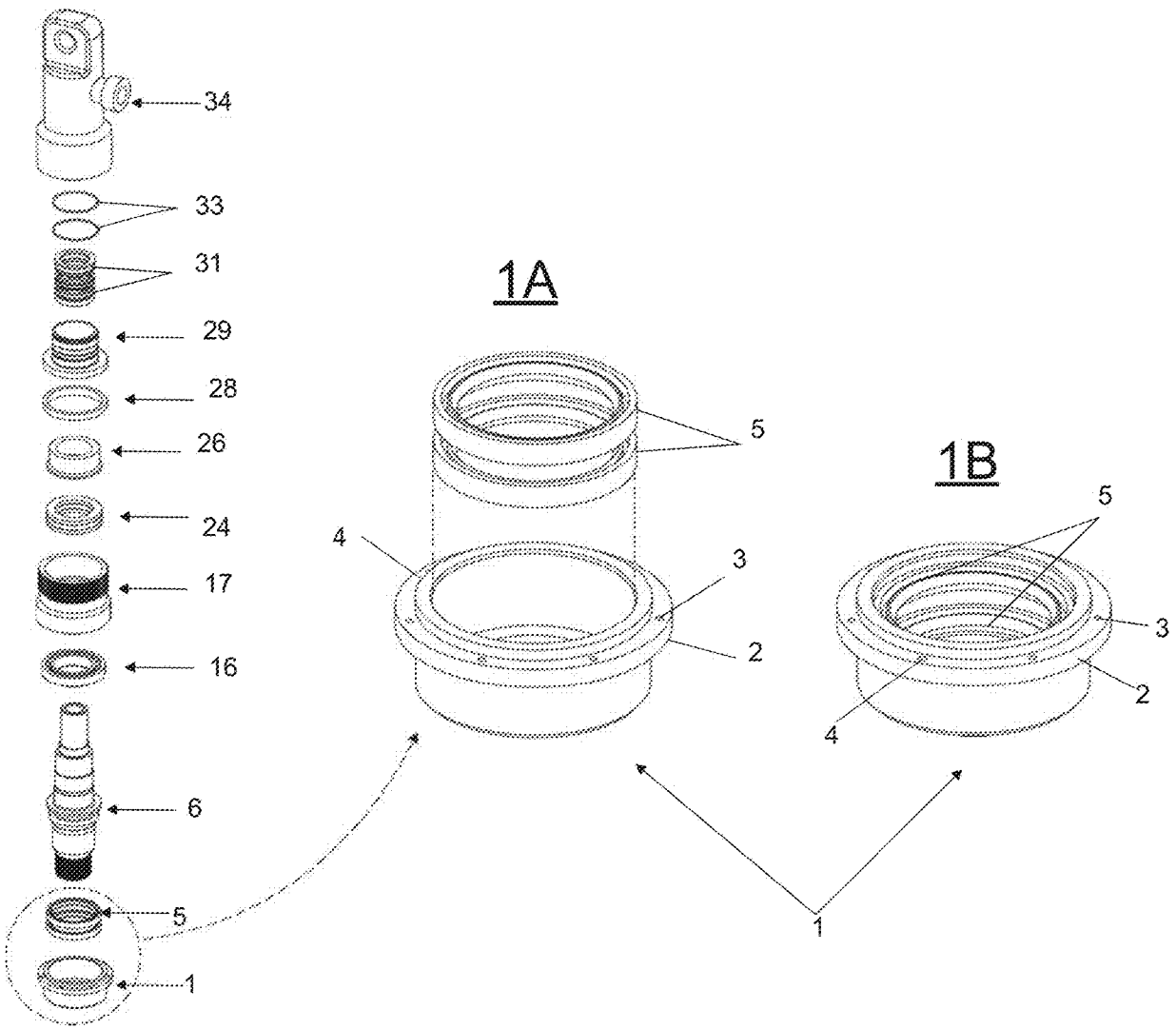
FIG. 1—exploded view of all device elements. In such view, aligned in an upside-down manner, a lower retainer box is shown, which has a set of retainer rings and a receptor vented axle of a lower bearing, in addition to a mounting, where an upper bearing is located at. In this upper bearing, a bracket an a span ring are placed, over which an upper retainer box, retainer ring receptors and o'rings are placed as well. In this view upper section, an upper head with an open nozzle is shown, along with a fluid input and an upper eyelet. On the expanded detail 1A, a lower retainer box is shown, in which its retainer ring set is aligned to. On expanded detail 1B, it shows the retainer rings internally placed to the lower retainer box.
Figure 2:
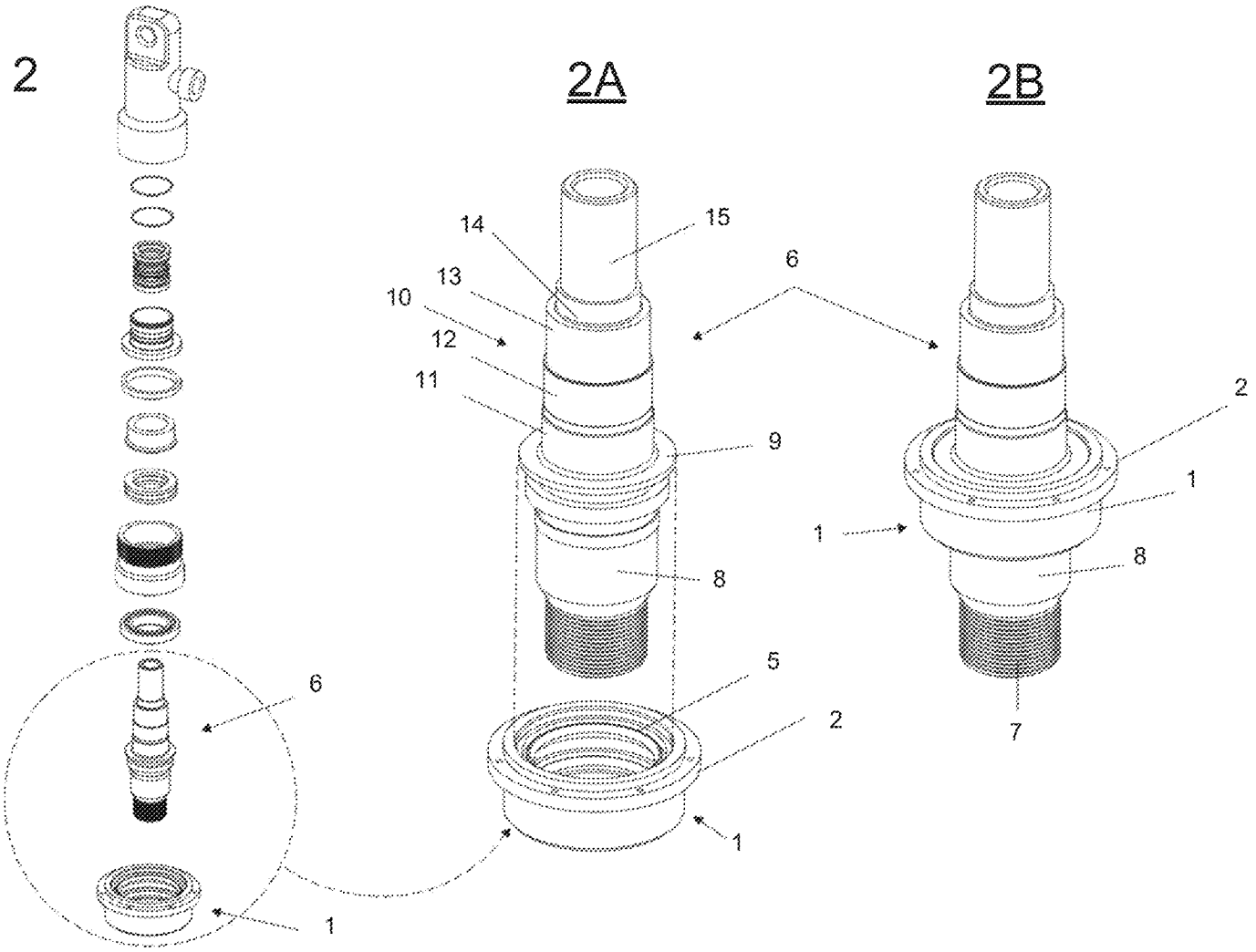
FIG. 2—view of the previous figure. On expanded detail 2A, a lower retainer box with its retainer rings, aligned to the vented axle, is shown. On 2B, it shows the vented axle is coupled to the lower retainer box, sealed through its inner retainer rings.
Figure 3:
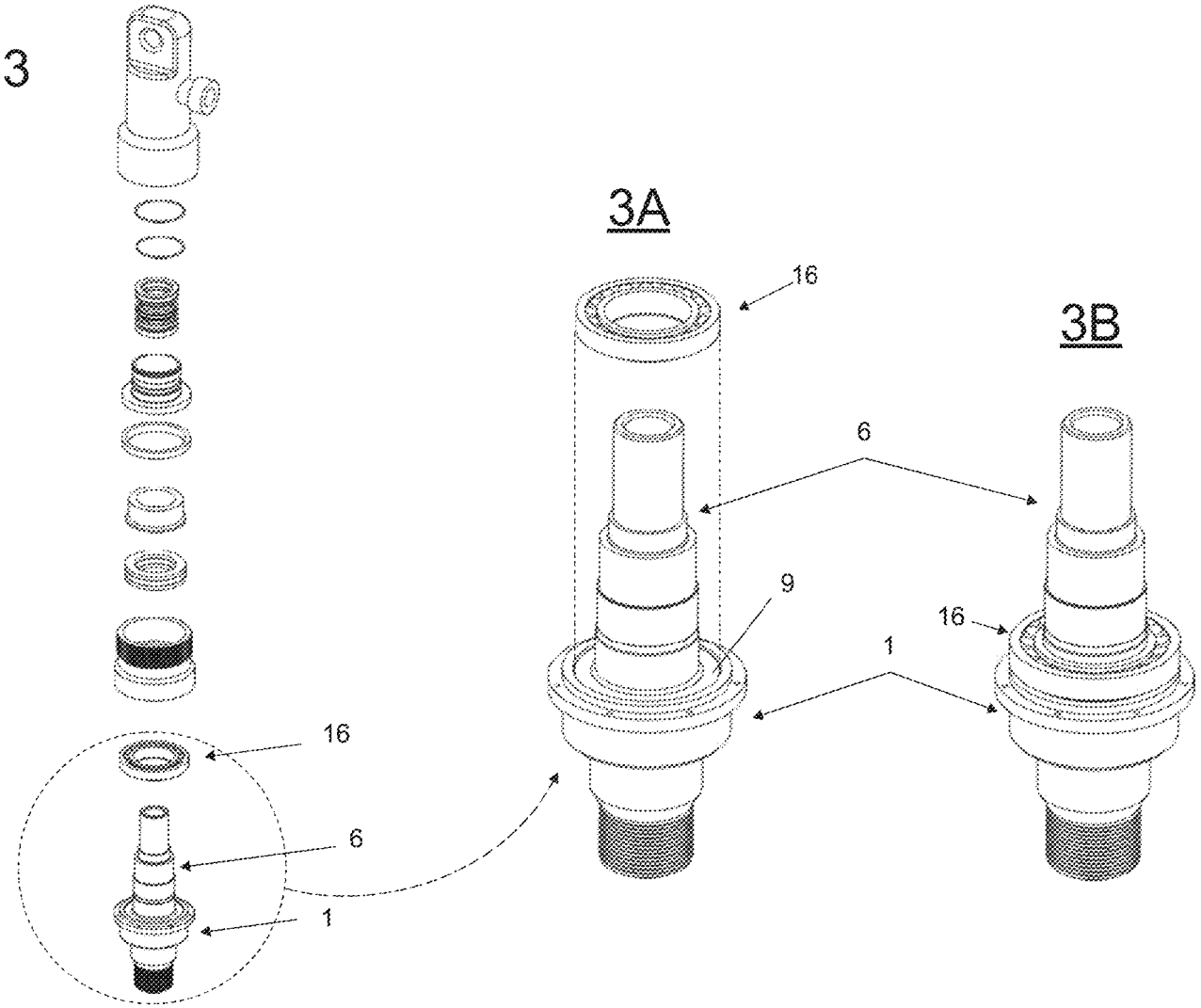
FIG. 3—view of the previous figure. On expanded detail 3A, it shows the lower bearing aligned to the vented axle. On 3B, it shows the lower bearing inserted by the vented axle and put into the lower retainer box throat.
Figure 4:
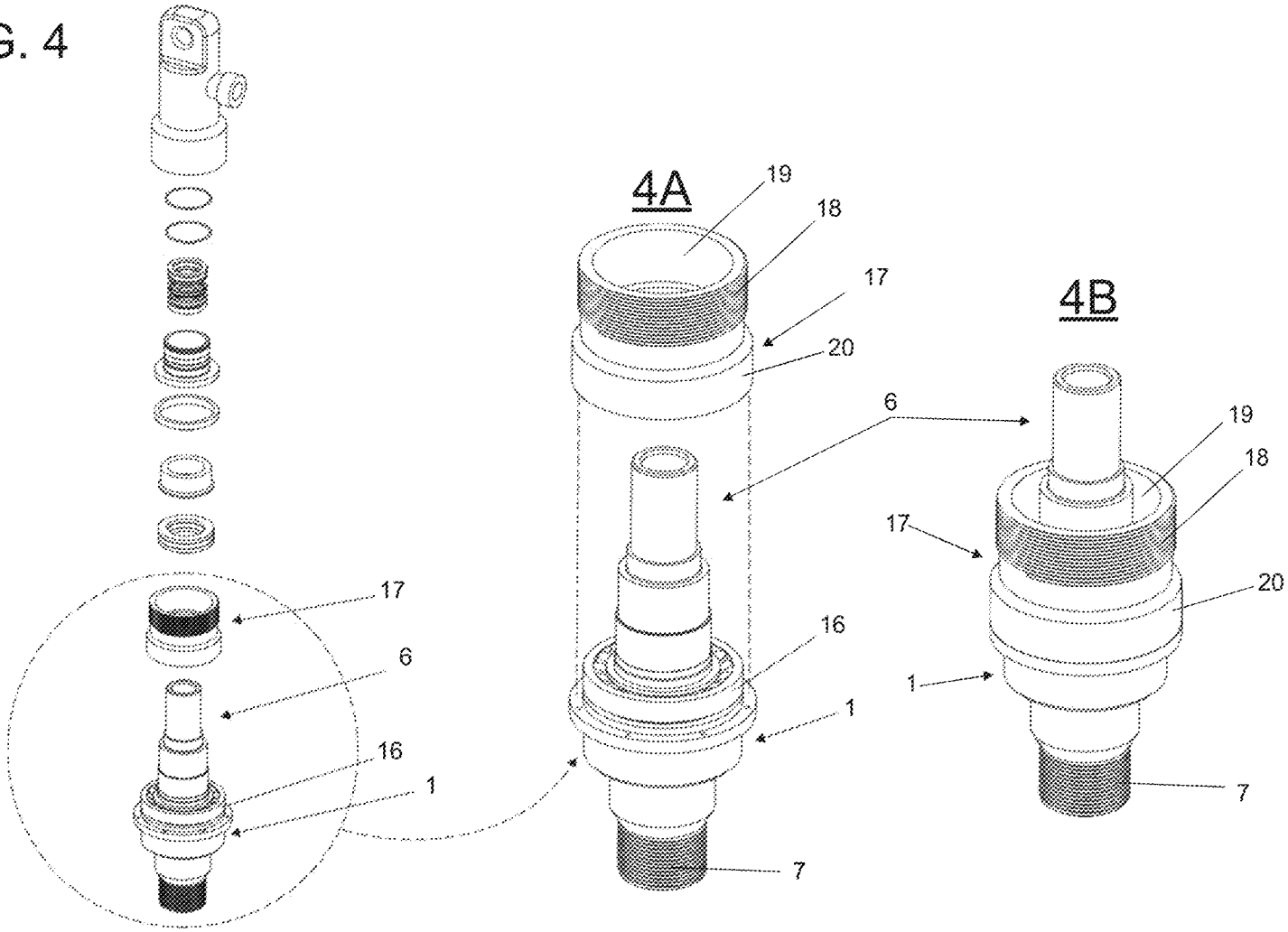
FIG. 4—view of the previous figure. On expanded detail 4A, the mounting aligned to the vented axle is shown, which is assembled to the lower retainer box. On 4B, it shows the mounting enveloping the vented axle and it is placed on the lower retainer box edge to be screwed between both of them (lower retainer box and mounting)
Figure 5:
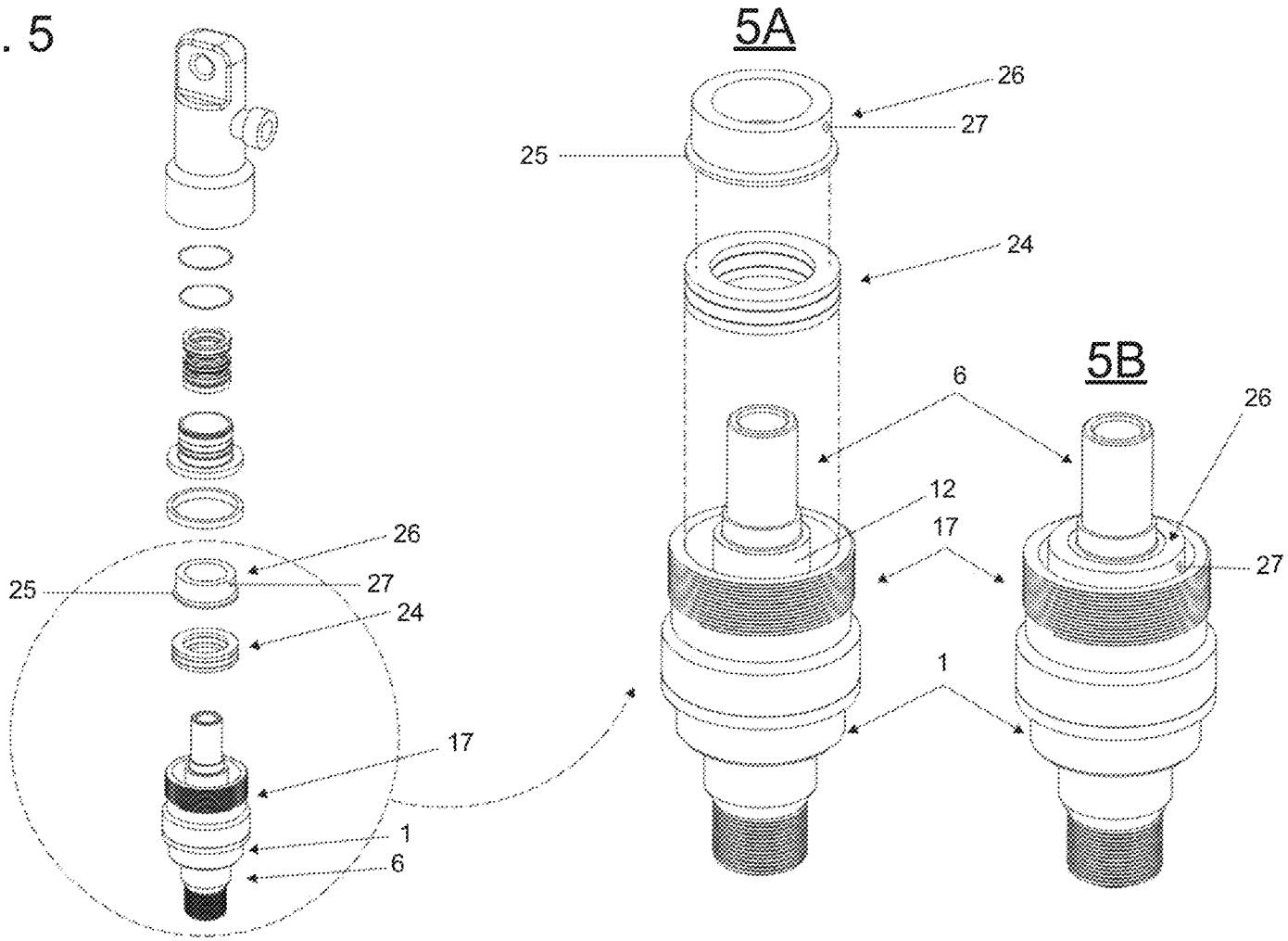
FIG. 5—view of the previous figure. On expanded detail 5A, it shows the upper bearing is aligned to the mounting, and a cylindrical bracket is put over the latter. On expanded detail 5B, it shows the upper bearing and the cylindrical bracket also enveloping the vented axle, and they are placed inside the mounting. In such condition, the cylindrical bracket is screwed in the vented axle through a hole in its wall.
Figure 6:
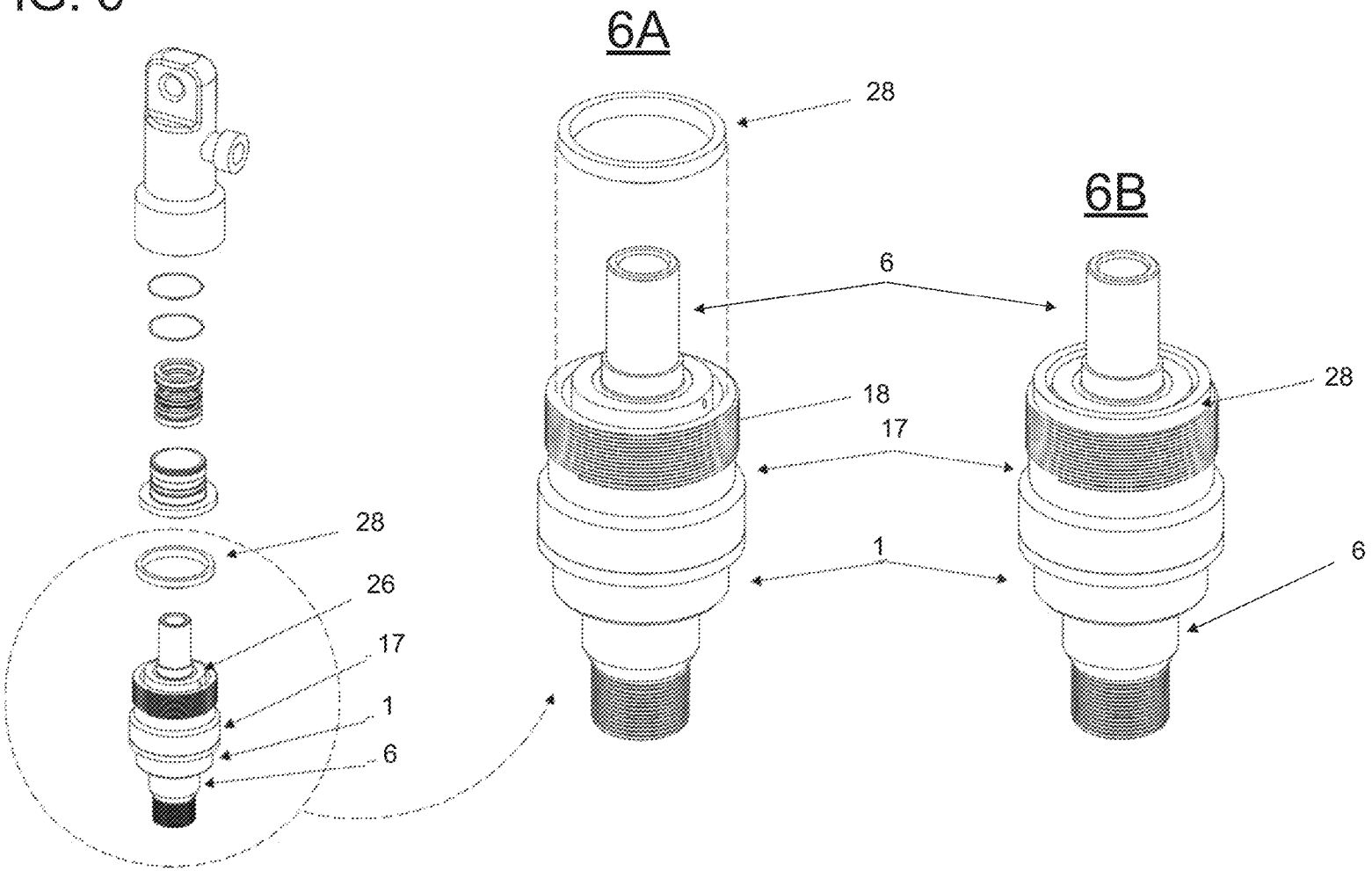
FIG. 6—view of the previous figure. On expanded detail 6A, it shows the span ring is aligned to the mounting. On expanded detail 6B, it shows the span ring exceeded the vented axle and it was placed in the mounting in order to envelope the cylindrical bracket.
Figure 7:
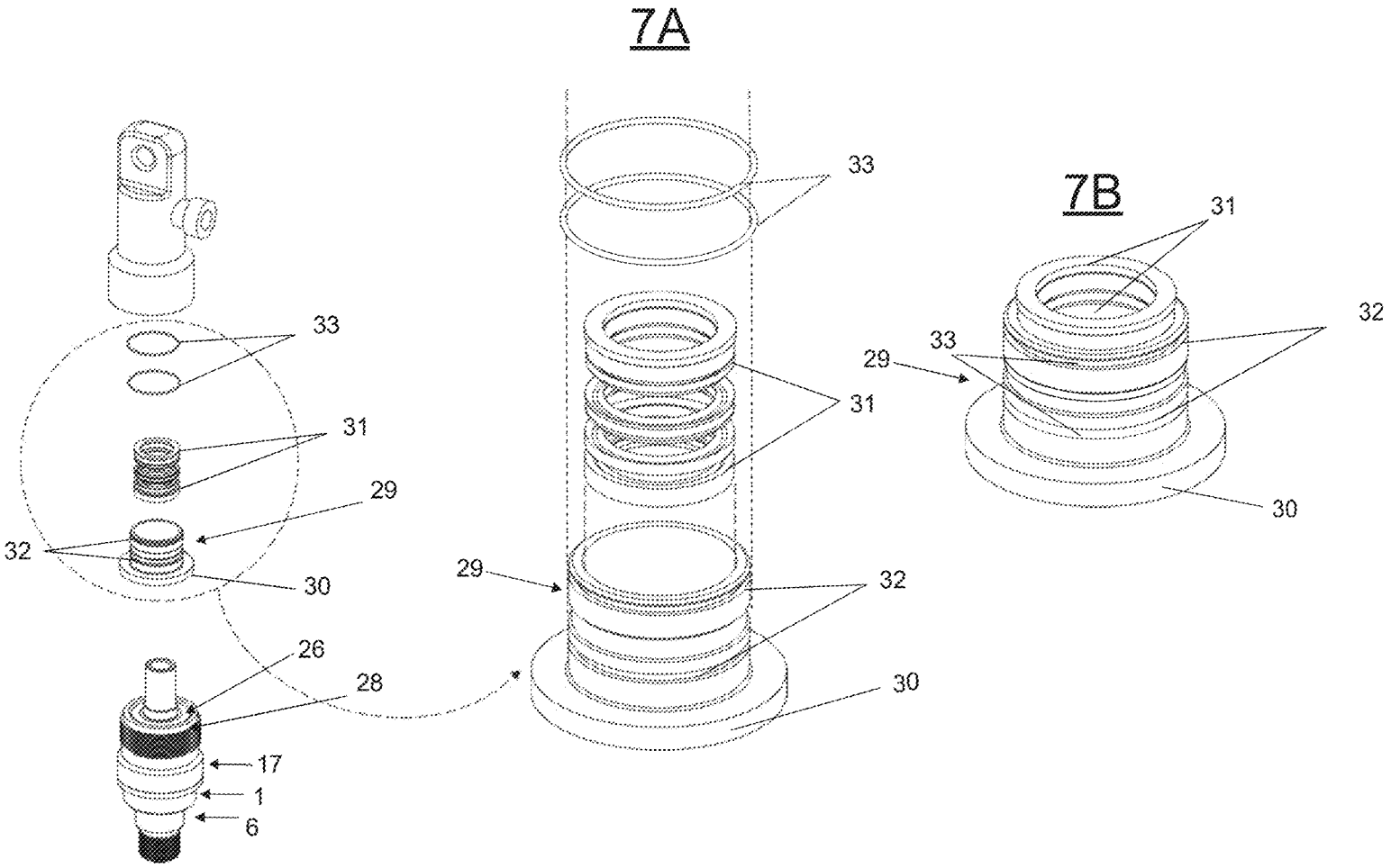
FIG. 7—view of the previous figure. On expanded detail 7A, it shows the retainer ring set and o'rings are aligned to the upper retainer box. On 7B, it shows the retainer rings have been placed inside the upper retainer box, which contains the o'rings under its outer flats.
Figure 8:
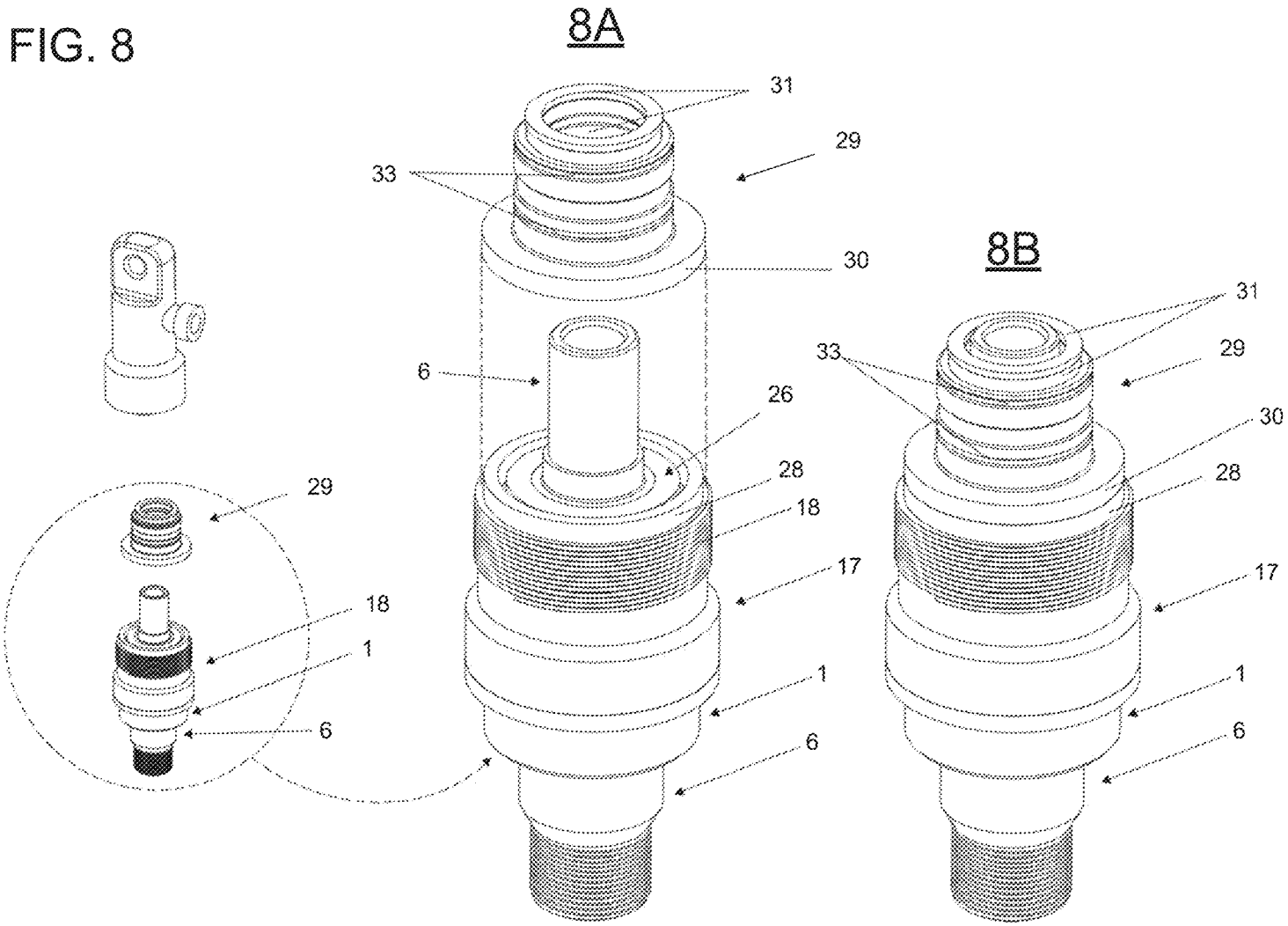
FIG. 8—view of the previous figure. On expanded detail 8A, it shows the upper retainer box already assembled with retainer rings and the o'ring is aligned to the span ring into the mounting. On 8B, it shows the upper retainer box has been inserted by the vented axle, which in turn was enveloped by retainer rings. The retainer box has been placed onto the span ring.
Figure 10:
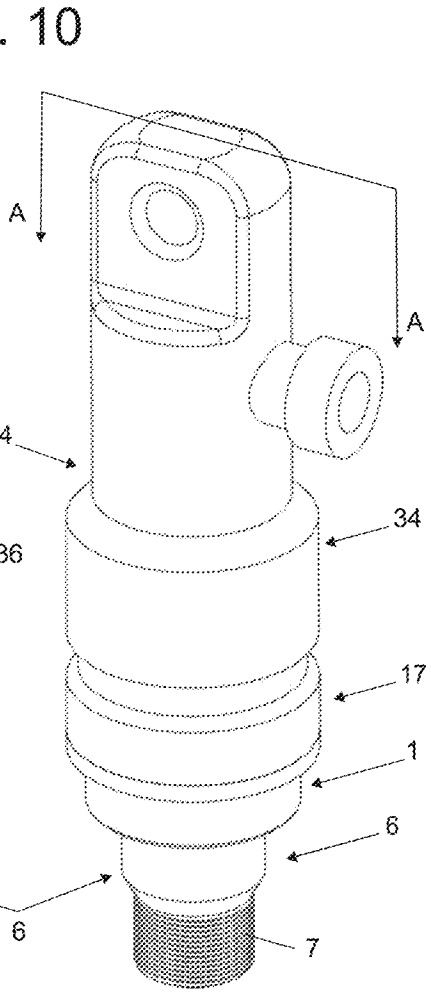
FIG. 10—views of the previous figure, as it shows a lower and upper perspective of the assembled device ready to be used. In the upper view, section A-A is indicated.

According to the attached drawings the "ASSEMBLY AND INSTALLATION SYSTEM DEVICE IN A COATING COLUMN COUPLED TO A CHUCK FOR A PROBING SHAFT CLEARING", object of the patent of invention request hereof, is comprised of a lower retainer box (1) with a cylindrical body, with an edge (2) vented by a radial hole (3), as it delimits the setback throat (4), and the said box (1) contains retainer rings (5), as shown in 1B, thus assembled to have its body surpassed (1), from a vented axle (6). This vented axle (6) has an externally threaded lower end (7) and, after its lowering, it creates a lower throat (8) delimited by a central stopper (9). After the said central stopper (9), the vented axle (6) extends an upper tower (10), spread in a diameter gradual reduction per degrees, forming a lower part (11), an intermediary part (12) and an upper part (13), incorporating a nearby ledge (14) from which the upper end extends itself (15), as shown in 2A and 2B.

The lower retainer box (1), along with its retainer rings (5) is surpassed by the threaded lower end (7) of the vented axle (6) and places its edge (2) in parallel to the central stopper (9) of the latter. Then from the upper end (15), the axle (6) accommodates the lower bearing (16) that is placed over the central stopper (9), as shown in 3A and 3B, followed by a mounting (17) with a threaded upper end (18), externally forming an inner upper housing (19), in addition to a nearby lower valance (20) with a radial hole (21), which forms an inner lower housing (22). By introducing the mounting (17), the housing (22) envelopes the lower bearing (16) and the mounting's nearby edge aligns its holes to the retainer box (1) edge (2) holes (3), which are locked by bolts (23) around the central stopper (9) of the vented axle (6), as shown in 4A and 4B.

In the housing (19), inserted by the axle (6) loose end (15) and enveloping the intermediary part (12) of its tower (10), it contains an upper bearing (24) of a lower edge coupling (25), stressed from a cylindrical bracket (26), which is vented by a hole (27) into its wall, as shown in 5A and 5B. Through its hole (27), a thrust bolt (27*a*) is placed over the upper part (13) of the vented axle (6), followed by the insertion of a span ring (28), supported in setback on the mounting (17) threaded upper edge (18), as shown in 6A and 6B. As shown in 7A and 7B, an upper retainer box (29) with a stressed lower edge (30) contains retainer rings (31) inside it, and in its external nearby flats (32), o'rings (33) are also placed, as they go through the loose of the axle (6) end as well, (15) enveloping and sealing it by its retainer rings (33) and by its said stressed edge (30) placed on the span ring (28), as shown in 8A and 8B.

Figure 9:
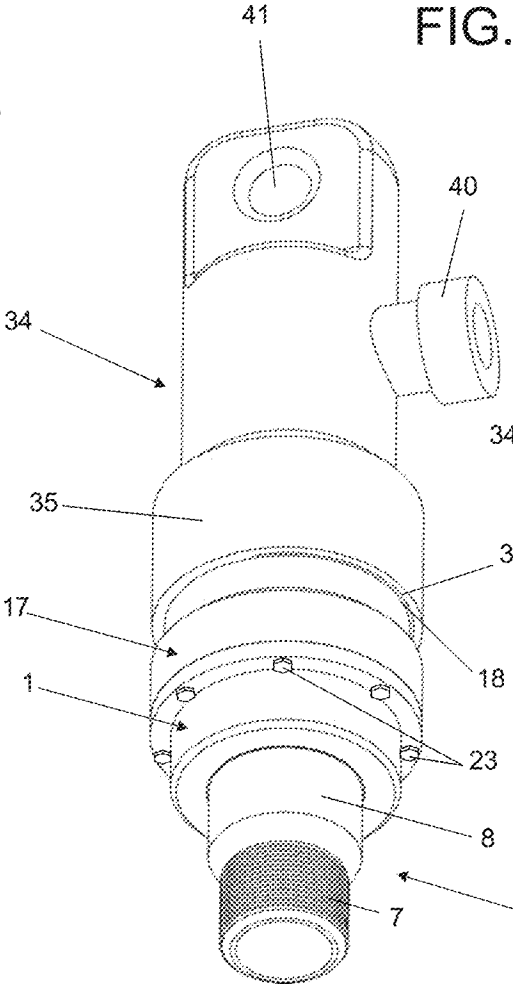
FIG. 9—view of the previous figure, as it shows the vented axle is already assembled with its upper and lower retainer boxes, and its bearings, locked amongst themselves with the mounting, cylindrical bracket and the span ring are aligned to the upper head nozzle.
Figure 9:
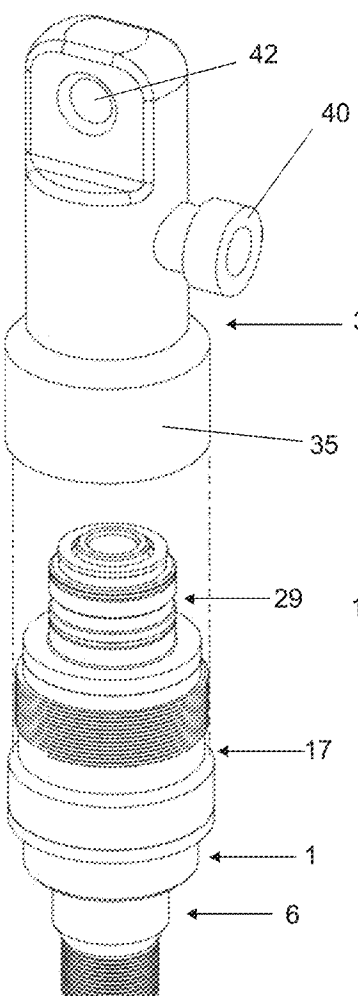
Figure 11:
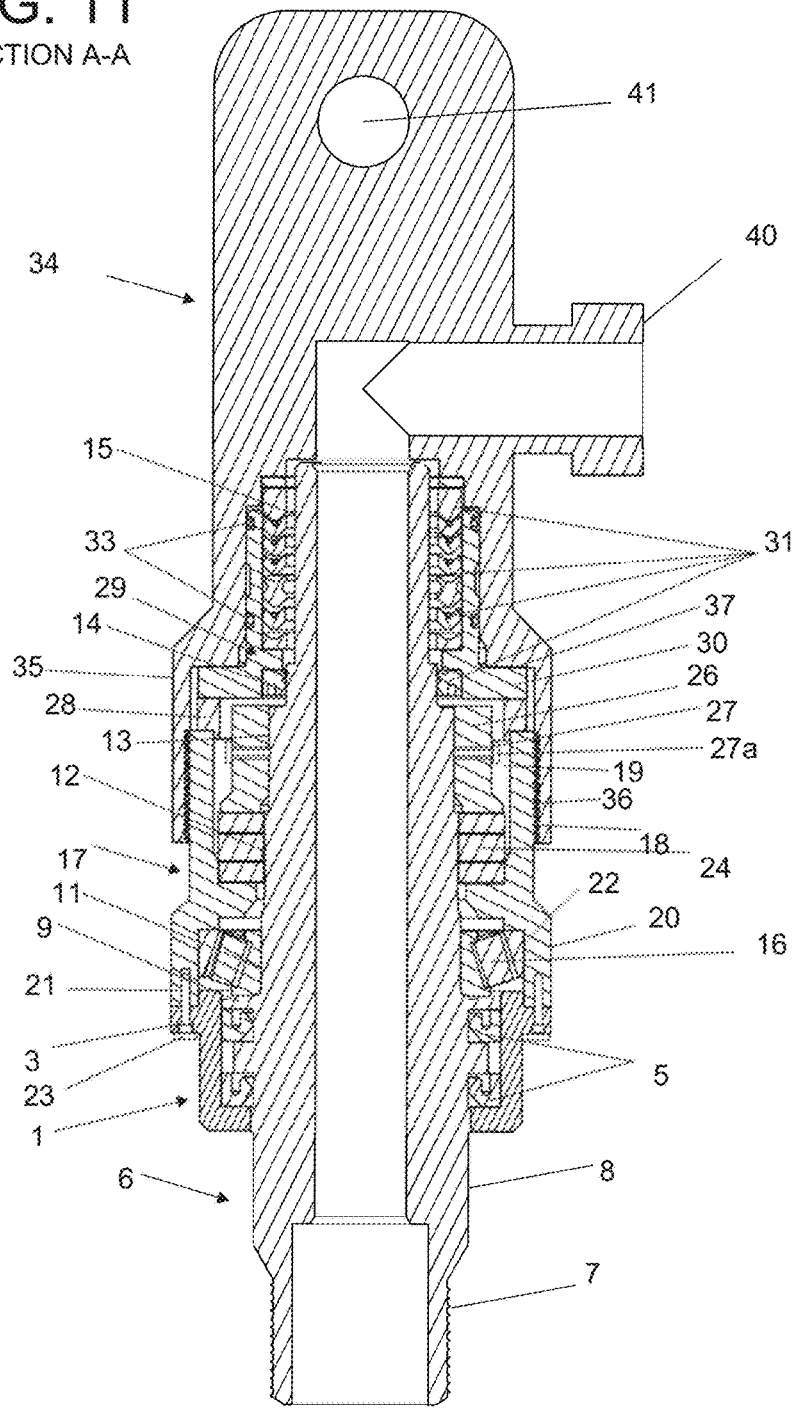
FIG. 11—view of side section A-A from the assembled device.

As shown in FIG. 9, from its loose end (15), enveloped and sealed by retainer rings (31) of the upper retainer box (29), the contained vented axle (6) takes an upper head (34) with a stressed open nozzle (35) with internal threads (36) and it is delimited by a stopper (37), from which a cradle is formed in a diameter-reduction operation, followed by a connecting route to a fluid input (40), as an eyelet (41) is also placed over the upper head (34) top. As shown in section A-A of FIG. 11, by its nozzle (35) threads (36), the upper head\ (34) is held to the mounting (17) upper edge (18), forming a passage, along with the assembled device and the vented axle (6), which extends from its lower end (7) to the fluid input (40).

According to the assembling explained above, with the bolt (27*a*) locking with the cylindrical support (26), placed over the upper bearing (24) on a mounting (17), the vented axle (6) is kept loose, i.e., may be able to spin over the upper head (34). In turn, the lower bearing (14) placed on the stopper (9) keeps the vented axle (6) always aligned to the inner connecting route with the fluid input (40) of the upper head (34). Now the retainer rings (5) and (31) of the corresponding lower and upper retainer boxes (1) and (29) keep the vented axle (6) sealed. Thus, through its fluid input (40) the device shall have an oversleeve (M) connection to a liquid cement reservoir (not shown) and, in its lower threaded end (7), it shall be threaded in the coating column (R) used in oil/gas drilling shaft (P) cementing operations.

Figure 12:
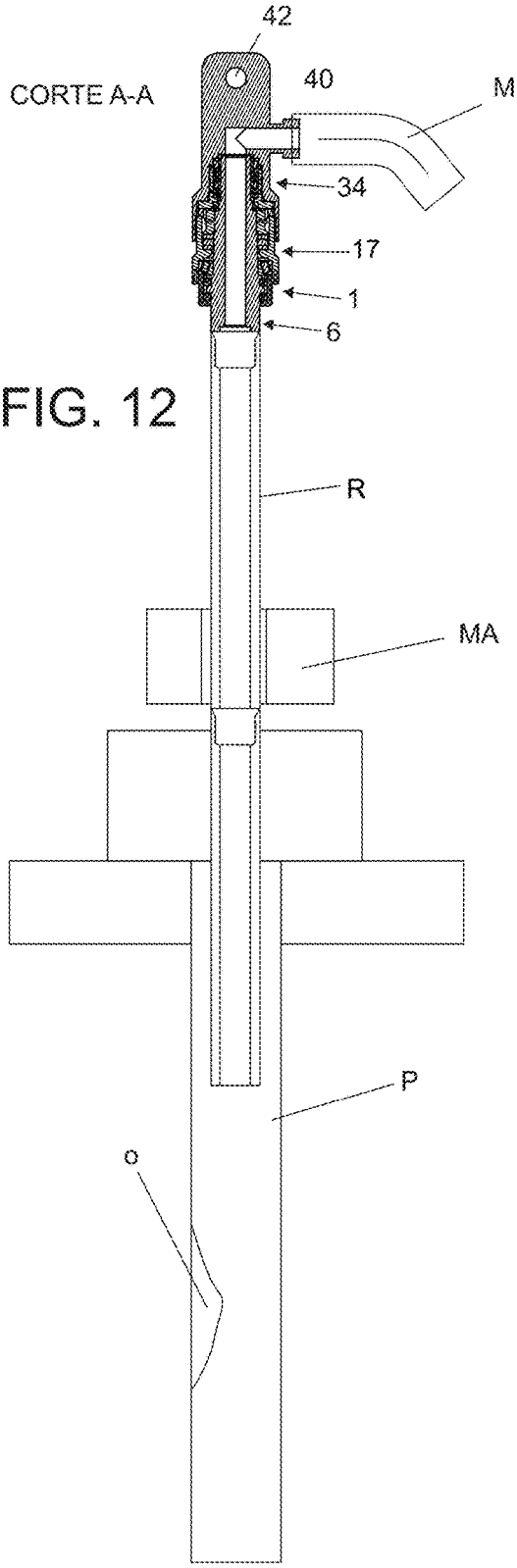
FIG. 12—view of the previous figure, as it shows the device position, installed in the coating column coupled to the probing equipment chuck. The coating column is introduced by the crane (not shown in the probing equipment) inside the drilling shaft for the cement injection phase.
Figure 13:
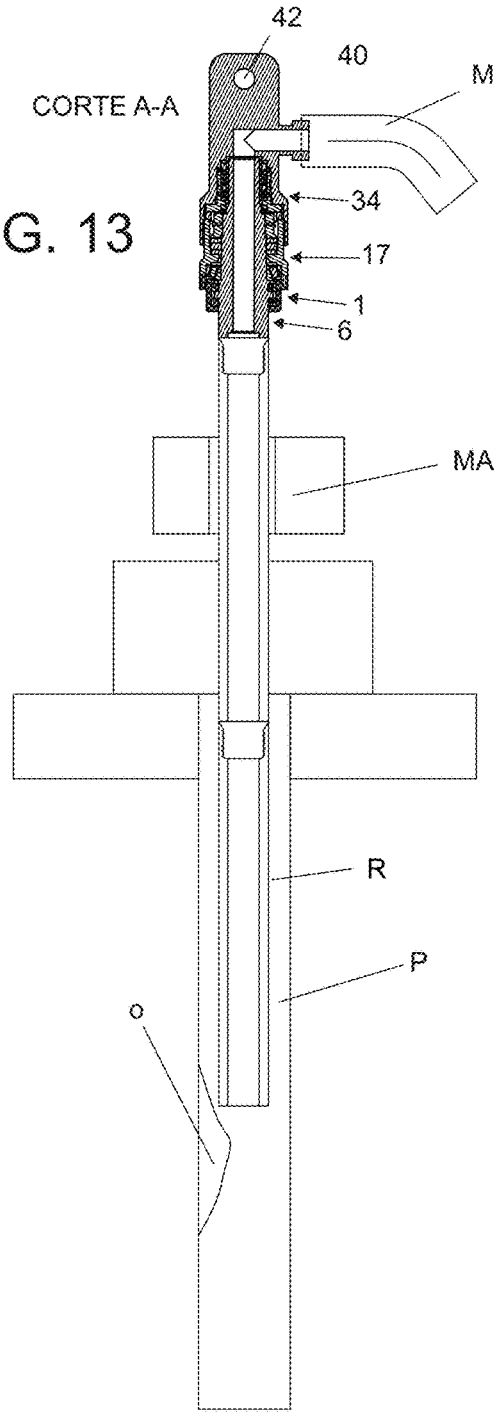
FIG. 13—view of the previous figure, as it shows the coating column terminal found an obstruction in the drilling shaft wall.
Figure 15:
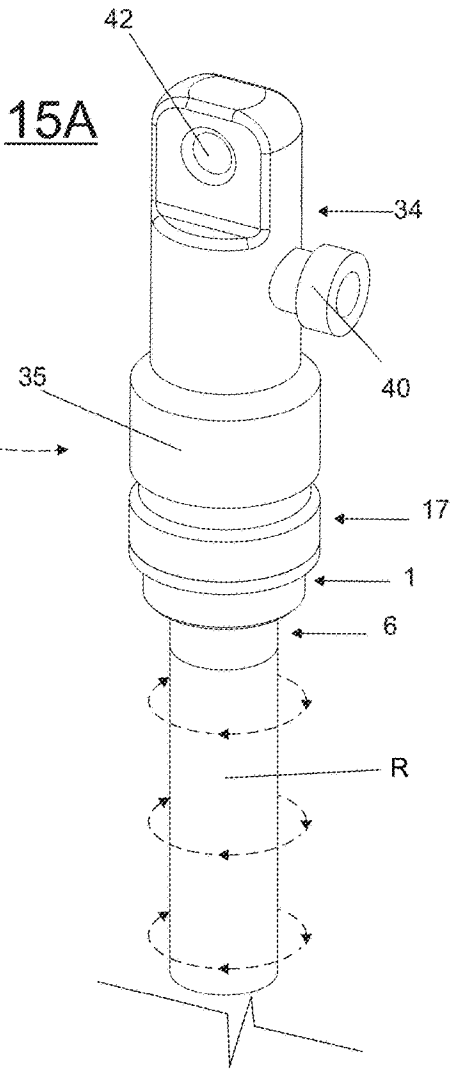
FIG. 15—view of the previous figure, as it shows the fluid pressure against the obstruction in the shaft wall, which is not enough to remove the said hindrance in this situation. On perspective detail 15A, after trying to remove the hindrance, it shows the coating column spin, activated by the probing equipment chuck.
Figure 15:
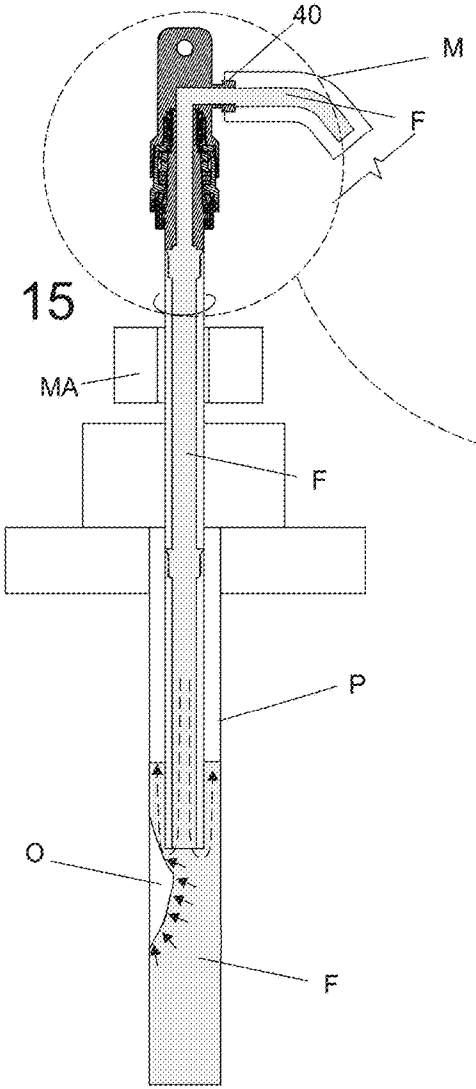
Figure 14:
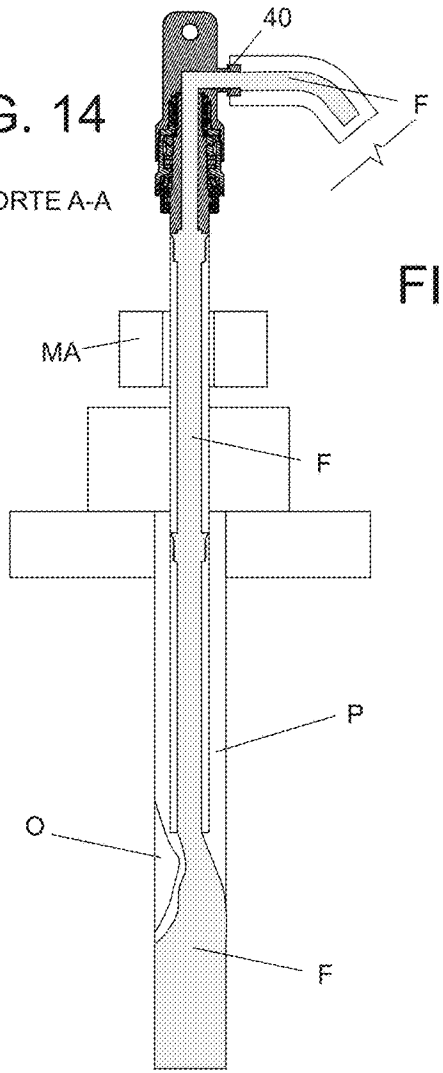
FIG. 14—view of the previous figure, as it shows the fluid injection inside the shaft through the coating column terminal, regarding the obstruction removal procedure.

In the eyelet (41) of the upper head (34), the coating column (R) couples the probing equipment column lifting system grip (not shown), as it is directed and coupled to the platform chuck (MA), whose clamping jaws relieve the pressure, opening itself and making it able to lower it inside the shaft (P), as shown in FIG. 12. As shown in FIG. 13, if the coating column finds a hole or hindrance in the shaft (P) wall while lowering, caused by rock displacements or swelling due to hydration or the drilling or by removing the chaplet drill, a fluid (F) is injected under a strong flow through the oversleeve (M). Even so, if the fluid (F) pressure is not enough, as shown in FIGS. 14 and 15, it activates the proposed system, in which the coating column (R) shall start spinning slowly and constantly after locking the chuck clamping jaws (MA), as shown in 15A.

Figure 17:
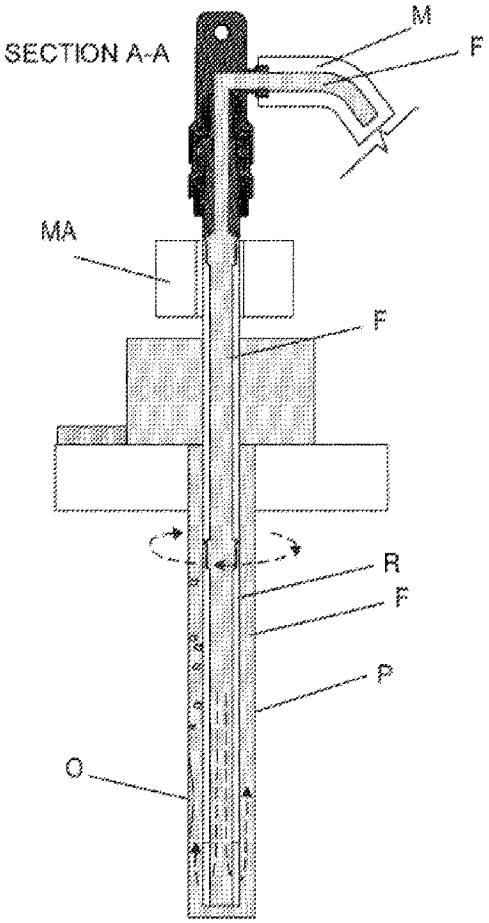
FIGS. 16 and 17—views of section A-A, as they show the coating column spinning simultaneously to the fluid injection. In this combination of spinning and injection onto the coating column, it helps removing the obstruction as it dissolves in particles.
Figure 16:
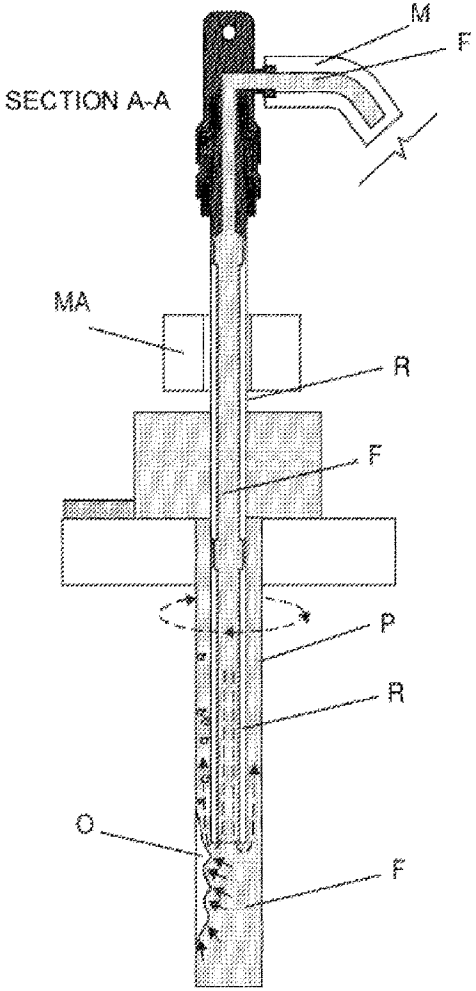

Due to fact the axle (6) is assembled in a "loose" spin in the upper head (34) (in turn, it is static, fixed by the crane), such movement allows all the coating column (R) to have a continuous torque by chuck (MA) action, receiving the fluid (F) simultaneously from the input (40) and threaded end (7) of the device, in a great pressure, as it is injected through the said column terminal. Thus the spin combined to the injection will thin or erode the hindrance (O) in a quick and effective manner. With the thinning, as shown in FIGS. 16 and 17, due to the flow and pressure applied by the fluid (F), wastes are pressed upwards by the shaft void gap until it reaches the platform, where such material (waste+fluid) is filtered to be reinserted in the shaft (P) until the hindrance (O) is totally removed. After clearing it, the chuck (MA) interrupts the coating column (R) spin, which lowers itself to the shaft (P) bottom. The fluid (F) is then replaced by the cement past to normally cement the space between the coating and the shaft (P) wall without making maneuvers and using additional equipment, making this important shaft clearing procedure much easier.

A sequence of procedures is listed below for the coating column lowering. The indicated technical specifications in English are used in all national territory and, therefore, are kept in this patent request.

Operational Procedure for Production Coating Lowering 1. QHSE 15.1 Wear the complete PPE for operations within the area;

15.2 Make a work risk evaluation, when necessary;

15.3 Open a work permit (PT), when necessary;

15.4 Wear a safety belt while working at high heights;

15.5 While checking unsafe operations or conditions, suspend the work;

1.6 Isolate the area while moving loads, carrying out hot working. Pressure tests etc.;

1.7 If you have any doubts about such works, call a safety technician or consult a supervisor.

2. Initial Inspection 2.1 Ensure the wear bushing is recovered while concluding the drilling operation, after removing the column from the shaft ("SDS-PROC-PI-002—Wear Bushing Installation and Uninstalling"). Remember the blind compartment shall be closed between operations in order to keep the shaft safety;

2.2 Ensure 4½" tube compartment is replaced by 3½" tube compartments, and after replacing it, carry out BOP full or partial test, depending on the last test date, following the procedure "SDS-PROC-PI-001—BOP Test";

2.3 Have a tally promptly, prepared by Operator's Company Man, assuring the coating is duly jigged before lowering it in the shaft;

2.4 Provide the platform with all equipment and procedures needed to lower the coating.

3. Tools needed for lowering 3.1 Bucking machine;

3.2 Monkey wrench;

3.3 Spinning wrench with Torque wrench; 3.4 Hammer;

3.5 Special lubricant for coating; 3.6 Steel brush and lime;

3.7 Spinning Head: 3½" DE—Thread 2⅞" NW CX×3½" FJL VAM Pin×5000 psi Spinning Head 3½" DE—Thread 2⅞" NW Pin×3½" FJL VAM Box×5000 psi. (ASSEMBLY AND INSTALLATION SYSTEM DEVICE IN A COATING COLUMN COUPLED TO A CHUCK FOR A PROBING SHAFT CLEARING);

3.8 Spinning Head 4½" DE—Thread 2⅞" NW×5000 psi and Spinning Head 3½" DE—Thread 2⅞" NW×5000 psi;

3.9 Lifting Coating Sub 3½" VAM TOP—Thread 3½" FJL VAM Box and Lifting Coating Sub 3½" VAM TOP—Thread 3½" FJL VAM Pin×5000 psi;

3.10 Let Down Tube 3½" DE—Thread 3½" HRQ Pin×3½" HRQ Box×5000 psi, Crossing Sub 4½" DE—Thread 3½" HRQ Pin×3½" EUE Box×5000 psi, Crossing Sub 4½" DE—Thread 3½" EUE Pin×3½" HRQ Box×5000 psi;

3.11 Steel-cable coating lifter; 3.12 Scrambler for 30 tons;

3.13 A coating joint Pin VAM FJL 3½"×Pin VAM FJL 3½";

3.14 Manual wedge set with clamping jaws 3½"; 3.15 Araldite for flats and float collars (if needed);

3.16 Centralizers for coating of 3½" (in a shaft of 4⅞"). 3.17 Coating jig with drift of 2,797";

3.18 Coating lifter with a diameter of 7¹⁄₁₆". 4. Coating lowering procedure 4.1 Move all accessories and tools to the rig floor, such as spinning heads, coating lifter, spinning wrenches, torque wrenches, lubricants, oils etc;

4.2 Open the blind compartment to lower coating;

4.3 Coatings of 3½" with 9.2 lb/ft (13.69 kg/m) may be placed longitudinally regarding the probing length and shall be positioned in the headframe beside the tube slope, to raise them with a probe hoist and pipe handler. Ends with female threads VAM FJL shall be turned to the platform. Promptly have the Lifting Sub, with male thread VAM FJL. It shall not exceed an OD of 3½";

4.4 Install the manual wedge set under the opened foot clamp;

4.5 Remove the spinning head upper part;

4.6 Replace the clamping jaw set of 3½" in the hydraulic chuck and foot clamp of Genesis Probe. Install 3 guide sleeves of 3½": on top and on the base of the drill head and on top of the foot clamp. Remove the buses and lower the "leather cap" in the front and lower part of the probe rod, allowing the view of thread coupling;

4.7 By using two monkey wrenches (24") or spinning wrenches, previously screw Lifting Subs described in items 3.9, available in coatings, according to tally. Screw Lifting Subs as much as possible.

5. First step from 0 to 1500 m (hoist capacity of 40 klb or 18 ton);

5.1 The coating lowering shall be started with an open chuck;

5.2 With a hydraulic headframe beside the rod slope, lift the first coating joint with the connected Lifting Sub; 5.3 With a probe hoist already prepared with the lifter and cable scrambler (30 tons), raise the 1st tube of 3½" and put it into the hole;

5.4 With a bucking machine, torque the connection between Lifting Subs and coating.

5.5 Still with the hoist, lift the joint and place it over the shaft, with its (female) connection over the foot clamp;

5.5 Close the foot clamp, open the lifter and by using the bucking machine, break the connection torque with the Lifting Sub;

5.6 With a hydraulic headframe beside the rod slope, lift the next coating tube of 3½" with the connected Lifting Sub;

5.7 With a probe hoist already prepared with the lifter and cable scrambler (30 tons), raise the tube of 3½" and put it into the hole;

5.8 With a bucking machine, torque the connection between Lifting Sub and coating.

5.9 Raise the coating joint form the hole, placing it over the foot clamp, which is closed, holding the coating joint weight already lowered, leaving a coupling space to the bucking machine;

5.10 Move the bucking machine, placing it between the coating joints;

Still with a probe hoist, lower the coating smoothly inside the bucking machine, place the tube male thread FJL within the female thread, starting the first manual screw or with the help of a monkey wrench.

The invention claimed is:

1. A device for clearing obstructions in a drilling well comprising:

a fluid input, an upper head, a retainer box and a vented axle;

wherein said fluid input is configured for connection to a fluid reservoir, the upper head is connected to the fluid input at one end and the upper head is connected to a retainer box at the other end, the vented axle is rotatably connected to the retainer box and the vented axle further comprises threading for connection to a coating column and the vented axle.

2. The device of claim 1 wherein said retainer box further comprises bearings that allow the vented axle to rotate.

3. The device of claim 1 further comprising a spinning head that connects to the device and provides torque that causes the rotation.

4. A device for clearing obstructions in a drilling well comprising:

a generally cylindrical body which further comprises:

a lower retainer box having retainer rings that retain a lower edge of a vented axle, said vented axle having external threaded lower end, a lower bearing that sits on a ledge formed on the vented axle;

a mounting lower end is connected to an upper edge of the vented axle and fits around the lower bearing an upper bearing is inserted into the mounting a cylindrical bracket is inserted above the upper bearing a span ring is inserted on top of the cylindrical bracket, inner retainer rings are inserted on the cylindrical bracket o-rings are inserted above the inner retainer rings and a upper head is attached to the mounting upper end and covers the o-rings, said upper head further comprises a fluid input.

* * * * *